US009068760B2

(12) United States Patent
Tolleneer

(10) Patent No.: US 9,068,760 B2
(45) Date of Patent: Jun. 30, 2015

(54) HEATING APPLIANCE FOR AIR HEATING

(75) Inventor: Steven Tolleneer, Brasschaat (BE)

(73) Assignee: ROMATO, Brasschaat (BE)

( * ) Notice: Subject to any disclaimer, the term of this patent is extended or adjusted under 35 U.S.C. 154(b) by 620 days.

(21) Appl. No.: 13/426,354

(22) Filed: Mar. 21, 2012

(65) Prior Publication Data

US 2012/0240917 A1 Sep. 27, 2012

(30) Foreign Application Priority Data

Mar. 22, 2011 (BE) ..... 2011/0177

(51) Int. Cl.

| | |
|---|---|
| ***F23D 14/06*** | (2006.01) |
| ***F23D 14/70*** | (2006.01) |
| ***F23D 14/84*** | (2006.01) |
| ***F24H 3/08*** | (2006.01) |
| ***F23C 3/00*** | (2006.01) |
| ***F23D 14/04*** | (2006.01) |
| ***F23D 14/08*** | (2006.01) |
| ***F23D 14/82*** | (2006.01) |
| ***F23D 23/00*** | (2006.01) |

(52) U.S. Cl.

CPC ..... *F24H 3/087* (2013.01); *F23D 14/84* (2013.01); *F23C 3/002* (2013.01); *F23D 14/045* (2013.01); *F23D 14/08* (2013.01); *F23D 14/70* (2013.01); *F23D 14/82* (2013.01); *F23D 23/00* (2013.01)

(58) Field of Classification Search

CPC ..... F23D 14/02; F23D 14/12; F23D 14/125; F23D 14/14; F23D 14/16; F23D 14/70; F23D 14/84; F23D 2900/00011; F23D 2900/00012; F23D 2900/00013; F23D 2900/14124

USPC ..... 126/110 B; 165/121, 76, 135, 136, 165/134.1; 431/192, 159, 352, 354, 171, 431/181; 432/249; 110/322, 323; 122/18.1–18.5, 503

See application file for complete search history.

(56) References Cited

U.S. PATENT DOCUMENTS

| | | | | |
|---|---|---|---|---|
| 1,718,984 | A | 7/1929 | Schramm | |
| 4,938,283 | A * | 7/1990 | Wood et al. | 165/135 |
| 6,880,548 | B2 * | 4/2005 | Schultz et al. | 431/354 |
| 7,631,640 | B2 * | 12/2009 | Hofbauer et al. | 431/100 |
| 2012/0178032 | A1 * | 7/2012 | Roy et al. | 431/178 |

FOREIGN PATENT DOCUMENTS

| | | |
|---|---|---|
| EP | 0 068 733 A2 | 1/1983 |
| EP | 0 706 013 A1 | 4/1996 |

* cited by examiner

*Primary Examiner* — David J Laux

(74) *Attorney, Agent, or Firm* — Sughrue Mion, PLLC

(57) ABSTRACT

A heating appliance including a burner and a heat exchanger including a bundle of heat conducting elements that form the primary channels through which the hot flue gases from the burner are guided via inputs that are opposite the burner, and which are connected together to close off the secondary channels that are formed between the aforementioned elements and through which the air to be heated can be guided. The burner is a premix burner that is positioned opposite the inputs of the primary channels, whereby the burner has a supply for a mixture of fuel and a sufficient quantity of air for the essentially complete combustion of the fuel, and whereby between the burner and the inputs of the primary channels there is a heat shield of a heat-resistant material with a passage opposite each of the aforementioned inputs.

12 Claims, 3 Drawing Sheets

HEATING APPLIANCE FOR AIR HEATING

BACKGROUND OF THE INVENTION

The present invention relates to a heating appliance for air heating, more specifically for heating air that is used for heating the spaces of buildings or similar.

Such heating appliances are used for domestic heating and industrial heating in buildings.

Heating appliances of this type contain a burner, a heat exchanger consisting of a bundle of heat conducting elements that form the primary channels through which the hot flue gases from the burner are guided via inputs that are opposite the burner, and which are connected together to close the secondary channels that are formed between the aforementioned elements and through which the air to be heated is guided along the outside of the elements.

Such heating appliances are known for example in EP 0.706.013.

Thus heat transfer takes place via the walls of the channels between the hot flue gases and the air to be heated.

For such heating appliances, traditionally atmospheric "in-shot" burners are often used whereby the fuel is sprayed centrally into the channels in a gaseous state, whereby the combustion largely takes place in the channels.

These burners have a relatively long flame that extends relatively deeply into the aforementioned channels.

For the combustion in the channels, secondary air at ambient temperature is introduced around the flame, whereby this secondary air also acts as a screen for the channel walls against the hot flame that would otherwise damage these walls.

Such heating appliances with "in-shot" burners ensure a very price-favourable heating solution with many benefits. However, they have the disadvantage that they cause relatively high emissions of harmful substances, such as nitrogen oxides.

The heat exchanger is generally constructed in a modular form from tubular heat exchange elements that are simple and cheap to produce and assemble.

Heating appliances are also known, which, instead of an "in-shot" burner, use a more modern premixed burner or 'premix burner' with lower emissions of harmful substances, whereby the fuel is mixed beforehand with the air needed for complete combustion.

In these burners, no secondary air supply is required for combustion.

Premix burners have a much shorter flame, whereby the entire combustion takes place only a few millimetres from the burner and whereby the entire capacity of the flame is thus released in this short distance.

Such premix-burners are not to be used with the known heat exchangers described above without taking additional measures, as the combustion heat is so concentrated that the walls of the heat exchanger would be damaged.

Proposals are known for combining a premix-burner with extra secondary air, as described in U.S. Pat. No. 6,880,548, but these proposals are complex to set up and do not provide the desired result.

The purpose of the present invention is to provide a solution to at least one of the aforementioned and other disadvantages.

SUMMARY OF THE INVENTION

To this end the invention concerns a heating appliance comprising a burner, a heat exchanger consisting of a bundle of heat conducting elements that form the primary channels through which the hot flue gases from the burner are guided via inputs that are opposite the burner, and which are connected together to close off the secondary channels that are formed between the aforementioned elements and through which the air to be heated can be guided, with the characteristic that the burner is a premix burner that is positioned opposite the inputs of the primary channels, whereby the burner has a premix chamber in which fuel and sufficient air for the essentially complete combustion of the fuel is mixed, and whereby between the burner and the inputs of the primary channels there is a heat shield of a heat-resistant material with a passage opposite each of the aforementioned inputs, whereby the periphery of each passage has dimensions that are smaller than the dimensions of the periphery of the opposite input, and there are flashover channels between two or more passages (22) that enable the flame to flash over from one passage (22) to another passage (22), and which are constructed as grooves in the side of the heat shield (17) oriented towards the burner (16).

The heat shield enables a premix burner with low emissions of harmful substances to be used with a heat exchanger consisting of a modular set of tubular heat exchanger elements so that the advantage of the premix burner, i.e. low emissions of harmful substances, can be combined with the advantage of a modular heat exchanger, i.e. a low price and simplicity.

Indeed, through the application of the heat shield, the walls, and especially the connection of the inputs of the primary channels, are protected against direct contact with the hot combustion gases.

Because the passages in the heat shield are narrower than the inputs of the primary channels of the heat exchanger, the hot gases only gradually come into contact with the walls of the heat exchanger, so that the temperature increase on the wall remains manageable.

The heat shield also acts as a radiation shield whereby the passages in the heat shield guide and channel, so to speak, the heat radiation in the flow direction of the primary channels, so that the heat radiation only strikes the walls of the primary heat exchanger elements at a shallow angle. In this way the temperature increase on the walls is limited so that the heat exchanger does not overheat.

The heat shield also protects the place where the individual inputs of the primary channels are connected together against heat radiation.

As the temperature increase is limited and manageable, the heat exchanger can be manufactured from cheaper materials, which yields is an economic advantage.

The flashover channels between the combustion chambers enable the flashover of the flame from one passage to another passage, so that the combustion is automatically spread over the entire area of the burner without a number of ignition mechanisms being required for this purpose. The grooves on one side of the heat shield can also be realised in a cheap and simple way.

The heat shield can be provided with a connection between an aforementioned passage and the environment, whereby this connection can form a seat for an ignition mechanism to ignite the combustible mixture when starting the heating in order to create a flame, or it can form a seat for a flame monitoring probe that ensures that when the flame goes out, the ignition mechanism is again activated or the fuel supply is shut off.

The invention also relates to a heat shield manufactured from a heat-resistant material for application in a heating appliance as described above, whereby the heat shield has a number of passages and whereby there are flashover channels between two or more passages that enable the flashover of the flame from one passage to another passage, and which are constructed as grooves in a side of the heat shield.

BRIEF DESCRIPTION OF THE DRAWINGS

With the intention of better showing the characteristics of the invention, a few preferred embodiments of heating appliances according to the invention are described hereinafter by way of an example, without any limiting nature, with reference to the accompanying drawings, wherein.

DETAILED DESCRIPTION OF THE INVENTION

Figure 1:
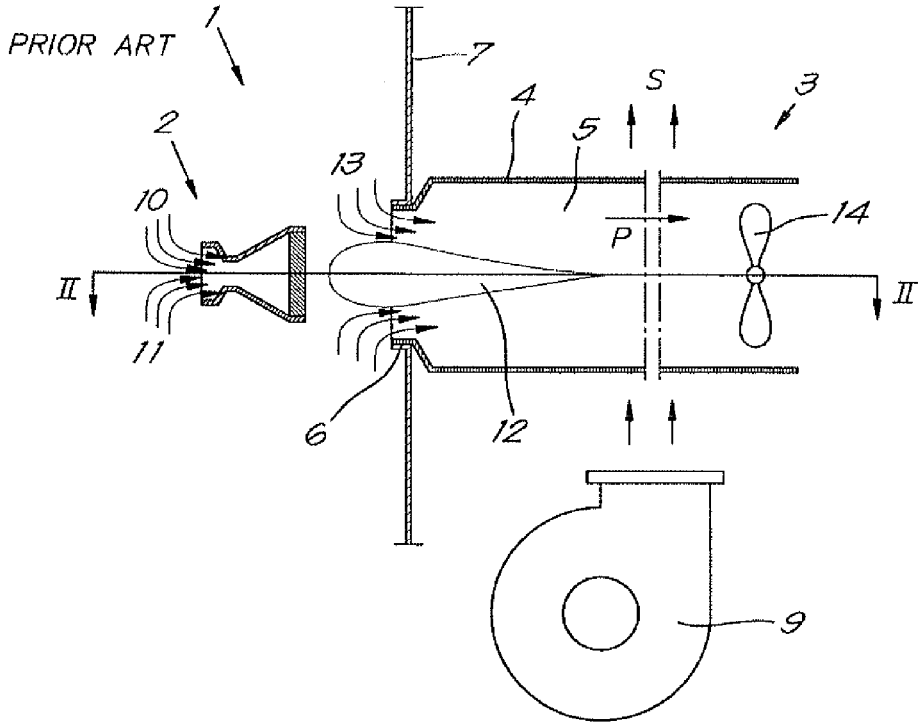
FIG. 1 schematically shows a heating appliance according to the state-of-the-art.
Figure 2:
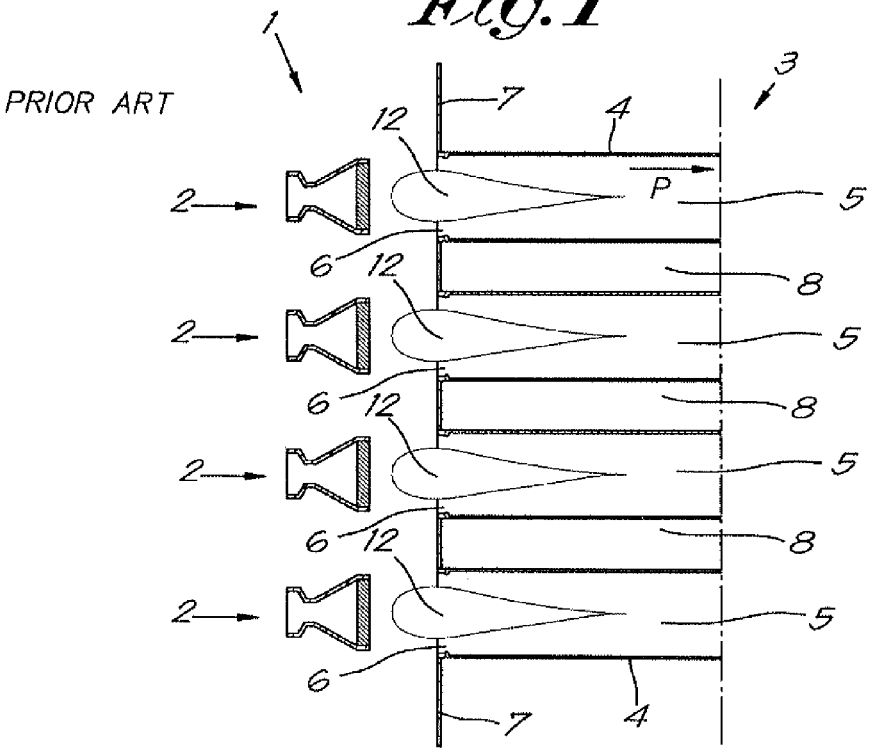
FIG. 2 shows a view according to arrow F2 of FIG. 1.

The heating appliance 1 of the known type shown in FIGS. 1 and 2 contains a burner 2, a heat exchanger 3 consisting of one or more tubular heat conducting elements 4 that form primary channels 5 through which hot flue gases from the burner 2 are guided in the direction of arrow P via inputs 6 that are opposite the burner 2.

The heat conducting elements 4 are connected together at their inputs 6 by means of a connecting plate 7 or similar to close off the secondary channels 8 that are formed between the aforementioned elements 4 and through which the air to be heated can be guided, for example by means of a fan 9 that draws in the surrounding air and blows it over the elements 4 in the direction of arrow S.

The burners 2 are atmospheric burners that are placed at a distance from heat exchanger 3, and in which gaseous fuel 10 is mixed with primary combustion air 11.

The gas mixture is injected in the primary channels 5 where it burns with a relatively long flame 12 that extends relatively deeply into the primary channels 5 and where it emits its heat, via the walls of the elements 4, to the air flowing through the secondary channels 8.

A flue gas fan 14 is mounted after the heat exchanger 3 that removes the flue gases via a flue gas channel, and which also draws in the secondary air between the burners 2 and the heat exchanger 3.

The walls of the heat exchanger 3 and the connecting plate 7 are cooled by the secondary air 13 drawn in.

This type of burner can only be used with a flue gas fan 14 after the combustion zone.

Although the primary channels 5 are presented here as straight channels, in reality these channels follow a curved path, for example a zigzag path.

Figure 3:
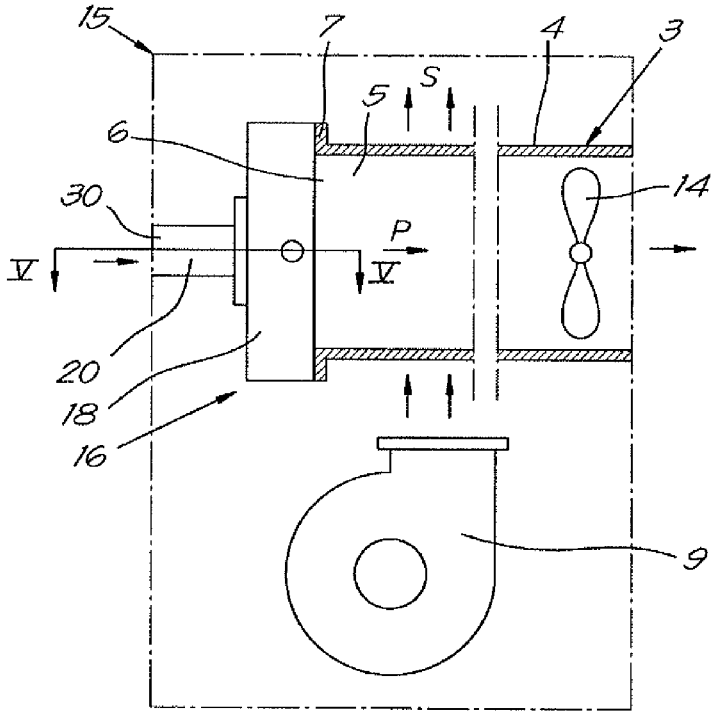
FIG. 3 schematically shows a heating appliance according to the invention.
Figure 4:
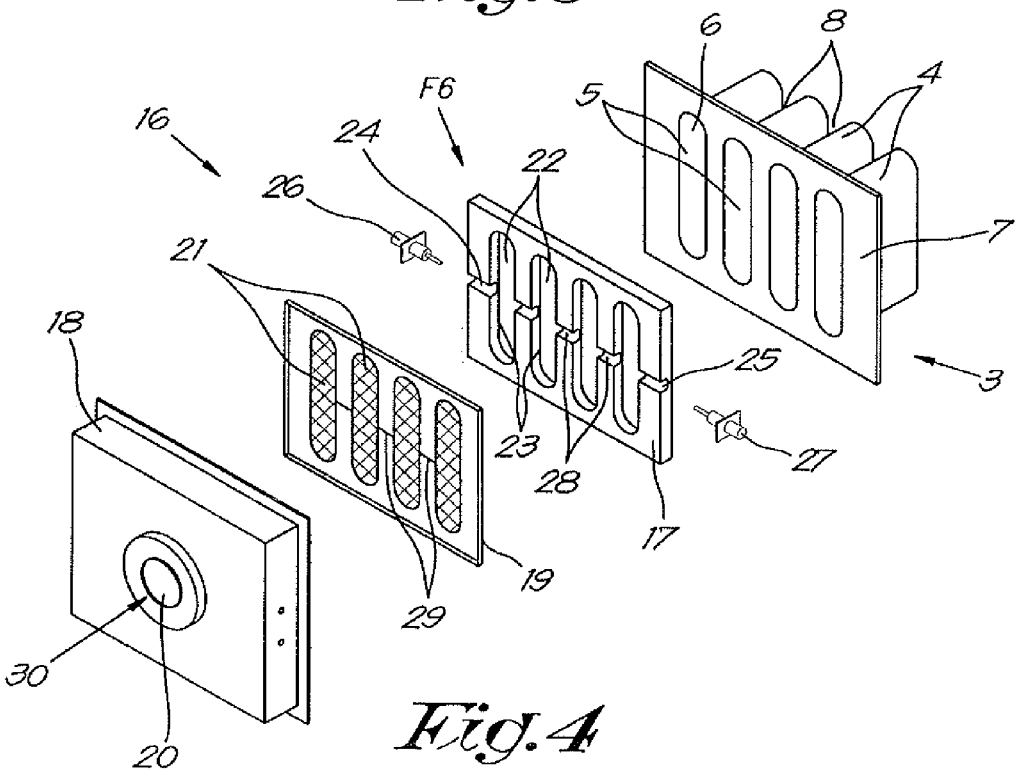
FIG. 4 shows an exploded view in perspective of a practical embodiment of the burner as indicated by F4 in FIG. 3.
Figure 5:
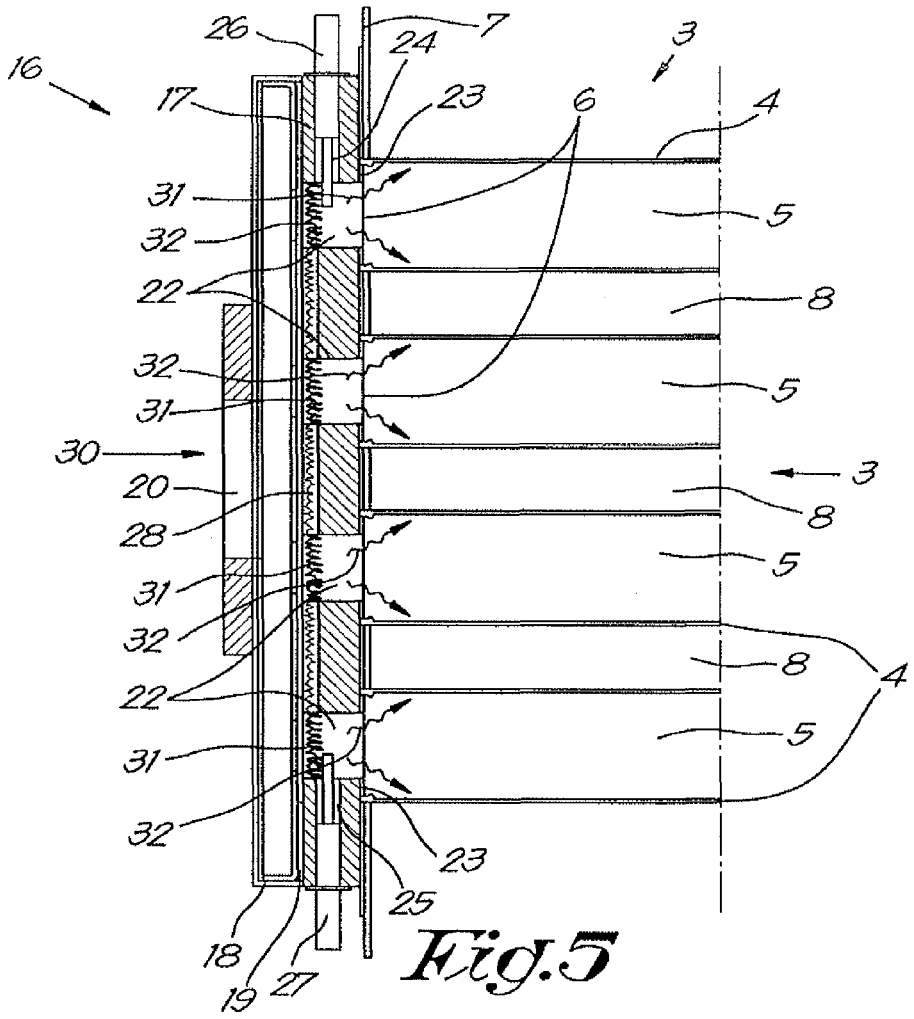
FIG. 5 shows a cross-section according to line V-V of FIG. 3 on a larger scale.

The heating appliance 15 according to the invention shown in FIGS. 3 to 5 essentially consists of the same elements, but the burners 2 are replaced by a burner 16 of the premix type that is mounted against the connecting plate 7 with the interposition of a heat shield 17.

The burner 16 contains a housing 18 with an open side in which a burner grid 19 is placed.

The housing 18 is further equipped with a supply 20 for a premixed combustible gas mixture of fuel and air in which the mix ratio is such that there is sufficient air in the mixture to ensure complete, or as good as complete, combustion without additional secondary air being required for this purpose.

The fuel-air mixture is distributed through the combustion grid 19 to the inputs 6 of the primary channels 5 and to this end there are outputs 21 opposite the inputs 6, whose shape is approximately the same as that of the inputs, but somewhat smaller. In the example shown, the inputs 6 and the outputs 21 have a, elongated shape and define the flame zones of the burner, so to speak.

In this case, the burner grid 19 and the heat shield 17 have a flat form, whereby the burner 19 is mounted as close as possible against the heat shield 17.

The heat shield 17 is manufactured as a plate of heat-resistant material, for example refractory stone, with a certain thickness of one to five centimetres for example, preferably of two and a half centimetres, and has passages 22 opposite each of the aforementioned inputs 6 of the primary channels 5 and the outputs 21 of the burner grid 19, whereby these passages 22 act as separate combustion chambers, so to speak.

The periphery of each passage 22 has dimensions that are smaller than the dimensions of the periphery of the opposite input 6, whereby the periphery of the aforementioned passages 22 on the side of the heat shield 17 oriented towards the heat exchanger 3, has the same, but somewhat smaller, shape as the periphery of the inputs 6 of the primary channels.

In this way the edge 23 of the passages 22 protrudes inwards with respect to the periphery of the opposite inputs 6 of the primary channels 5.

This inward protruding edge 23 preferably has a width of a least one millimetre, preferably at least three millimetres, and even better at least five millimetres.

Furthermore, in the heat shield 17, for each of the two outermost passages 22 there is a connection 24 or 25 between the passage 22 concerned and the outside edge of the heat shield 17.

In the connection 24 there is an ignition mechanism 26, for example an electrode or hot surface igniter, to ignite the combustible mixture when the heating starts, while in the connection 25 there is a flame monitoring sensor 27, for example a photocell or ionisation protection. An ignition mechanism can also be combined with a flame monitoring sensor, in which case a single connection will suffice.

Furthermore, the passages 22 in the heat shield 17 are connected together by flashover channels 28, which in the example shown are constructed as grooves in the side of the heat shield 17 oriented towards the burner 16.

Flashover channels 29 can also be provided between the outputs 21 of the burner 16 for the flashover of the flame from one flame zone to another flame zone.

If the flashover channels 28 are constructed in the heat shield 17, the alternative is not inconceivable to provide a burner grid 19 with only one single output 21 that covers all passages 22 in the heat shield, and which is mounted against the heat shield 17. In this embodiment, the flame zones are, as it were, bounded by the passages 22 in the heat shield 17.

The operation of the heating appliance 15 according to the invention is very simple and as follows.

A premixed fuel-air mixture 30 is introduced in the premix burner 16 via the supply 20 and dispersed, via the outputs 21, in the flame zones of the burner 16 that are demarcated by the outputs 21 in the burner grid.

The mixture 30 is ignited by means of the ignition mechanism 26, such that flames 31 occur in the flame zones that spread, via the flashover channels 28 and/or 29, over all flame zones, and which extend from the burner grid 19 up to a short distance past it.

The combustion completely takes place over this short distance, whereby a very concentrated heat source occurs from which hot gases flow through the passages 22 of the heat shield 17 to the heat exchanger 3.

Once the hot gases have cooled sufficiently, they are removed by means of the flue gas fan 14 through a flue gas removal channel. In the case of the invention, the flue gas fan 14 can be before the burner 16 and after the heat exchanger 3.

As a result of the thickness of the heat shield 17, the passages 22 form, so to speak, guides that more or less channel the heat radiation 32 from the flame zones of the burner 16 in the flow direction of the primary channels, such that this heat radiation 32, as shown in FIG. 5, only contacts the walls of the primary channels 5 at a shallow angle, so that this radiation 32 only has a limited effect on the heating of these walls.

Furthermore, the flow of hot gases undergoes a widening of the flow passage when entering the primary channels 5, such that the flow speed and the turbulence of the flow decrease at the inputs 6, and the walls of the primary channels 5 are heated less in this place.

The walls of the primary channels 5 are thus protected against overheating.

The connecting plate 7 and the connections of the inputs 6 are covered by the heat shield 17, whereby these elements are also protected against overheating.

It is clear that the inputs 6 can also be connected to one another directly without the intervention of a connecting plate 7. In this case too, these connections are screened by the heat shield 17.

Figure 6:
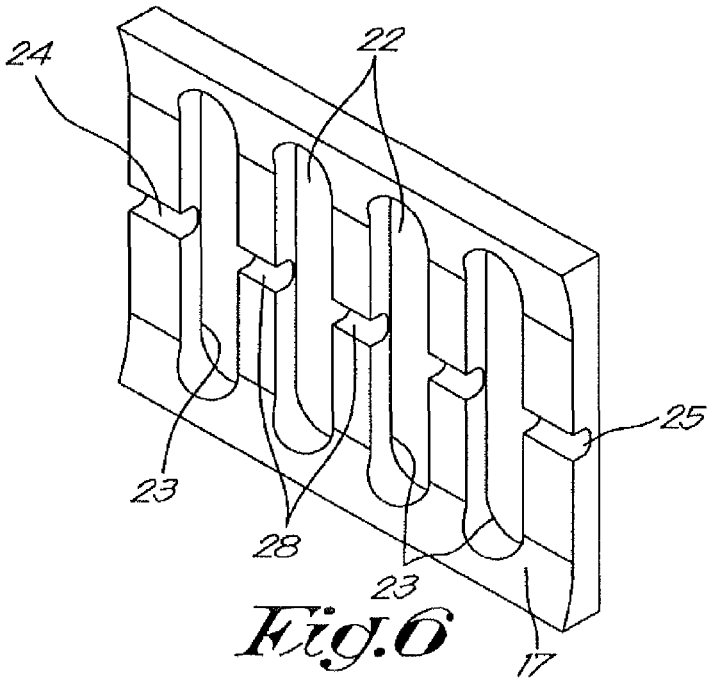
FIG. 6 shows a variant of a heat shield as indicated by F6 in FIG. 4.

Although the embodiment described above makes use of a flat burner 16 combined with a flat heat shield 17, it is not excluded to make use of a burner 16 and heat shield 17, one of which or both have a curved form. By way of an example, FIG. 6 shows a curved heat shield 17.

In this case the radius of curvature of the burner 16 is somewhat smaller, for example, than the radius of curvature of the heat shield 17, whereby neither the burner 16 nor the heat shield 17 have to be provided with flashover channels 28 or 29.

The present invention is by no means limited to the embodiments described as an example and shown in the drawings, but a heating appliance according to the invention can be realised in all kinds of variants, without departing from the scope of the invention.

What is claimed is:

1. A heating appliance comprising:

a burner (16), a heat exchanger (3) including a bundle of heat conducting elements (4) that form primary channels (5) through which the hot flue gases from the burner (16) are guided via inputs (6) that are opposite the burner (16), and which are connected together to close off secondary channels (8) that are formed between the heat conducting elements (4) and through which the air to be heated can be guided, wherein the burner (16) is a premix burner that is positioned opposite the inputs (6) of the primary channels (5), whereby the burner (16) has a supply (20) for a mixture (30) of fuel and a sufficient quantity of air for the essentially complete combustion of the fuel, and whereby between the burner (16) and the inputs (6) of the primary channels (5) there is a heat shield (17) of a heat-resistant material with a passage (22) opposite each of the inputs (6), whereby the periphery of each passage (22) has dimensions that are smaller than the dimensions of the periphery of the opposite input (6), and there are flashover channels (28) between two or more passages (22) that enable the flame (31) to flash over from one passage (22) to another passage (22), and which are constructed as grooves in the side of the heat shield (17) oriented towards the burner (16), wherein the periphery of the passages (22) in the heat shield (17) on the side of the heat shield (17) oriented towards the heat exchanger (3), has a smaller shape as the periphery of the inputs (6) of the primary channels (5).

2. The heating appliance according to claim 1, wherein the edge (23) of the passages (22) protrudes inwards with respect to the periphery of the opposite inputs (6) of the primary channels (5), and the inward protruding edge (23) has a width of at least one millimeter.

3. The heating appliance according to claim 1, wherein the passages (22) in the heat shield (17) form combustion chambers.

4. The heating appliance claim 1, where the thickness of the heat shield (17) is between one and four centimeters.

5. The heating appliance according to claim 1, wherein the heat shield (17) has at least one connection (24) between at least one passage (22) and the environment, whereby there is an ignition mechanism (26) in this connection (24).

6. The heating appliance according to claim 1, wherein there is at least one connection (25) in the heat shield (17) between at least one passage (22) and the environment, whereby in this connection (25) there is a flame monitoring probe (27) combined with an ignition mechanism (26).

7. The heating appliance according to claim 1, wherein the burner (16) is equipped with outflow openings (21) for the fuel-air mixture to demarcate flame zones that are opposite the passages (22) in the heat shield (17) and which have dimensions that are smaller than the dimensions of the opposite passages (22).

8. The heating appliance according to claim 1, wherein there are flashover channels (29) between the flame zones of the burner (16) that enable the flashover of the flame from one flame zone to another flame zone.

9. The heating appliance according to claim 7, wherein the burner (16) and the heat shield (17) are of a flat form.

10. The heating appliance according to claim 1, wherein the burner (16) and the heat shield (17) are of a curved form.

11. The heating appliance according to claim 10, wherein the radius of curvature of the burner (16) is smaller than the radius of curvature of the heat shield (17).

12. The heating appliance according to claim 1, wherein the flashover channels form a direct connection between the passages.

* * * * *